US008789689B1

(12) United States Patent
Wong

(10) Patent No.: US 8,789,689 B1
(45) Date of Patent: Jul. 29, 2014

(54) COLLAPSIBLE SPECTACLES CASE

(71) Applicant: Alison Wong, Chesterfield, MO (US)

(72) Inventor: Alison Wong, Chesterfield, MO (US)

( * ) Notice: Subject to any disclaimer, the term of this patent is extended or adjusted under 35 U.S.C. 154(b) by 0 days.

(21) Appl. No.: 13/794,477

(22) Filed: Mar. 11, 2013

(51) Int. Cl.
*A45C 11/04* (2006.01)
*A45C 7/00* (2006.01)

(52) U.S. Cl.
CPC ..... *A45C 7/0036* (2013.01); *A45C 11/04* (2013.01)
USPC ..... 206/6

(58) Field of Classification Search
CPC ..... A45C 11/04; A45C 11/043
USPC ..... 206/5, 6
See application file for complete search history.

(56) References Cited

U.S. PATENT DOCUMENTS

| | | | | | |
|---|---|---|---|---|---|
| 822,137 | A * | 5/1906 | Linnig | 206/5 |
| 2,723,745 | A * | 11/1955 | McNeill | 206/5 |
| 2,913,100 | A * | 11/1959 | Carmichael | 206/5 |
| 3,845,799 | A * | 11/1974 | Mittell | 206/5 |
| 3,977,516 | A * | 8/1976 | Tilve | 206/5 |
| 5,673,788 | A * | 10/1997 | McLane | 206/5 |
| 7,028,834 | B2 * | 4/2006 | Karpel | 206/5 |

FOREIGN PATENT DOCUMENTS

FR 2541097 A1 * 8/1984

* cited by examiner

*Primary Examiner* — Bryon Gehman
(74) *Attorney, Agent, or Firm* — Thomas Schneck

(57) ABSTRACT

A collapsible holder for protecting an article or articles contained therein, and in particular sunglasses, wherein at least four relatively rigid members are pivotally connected together, a separable closure and side pivoting tabs are provided so that the at least four relatively rigid members may be formed into a rigid rectangular shape, with one side arc-ed for extra support and more efficient use of space, for holding the sunglasses when not in use and folded into a compact relationship with the four relatively rigid members in a superimposed parallel relationship when the sunglasses are in use.

7 Claims, 4 Drawing Sheets

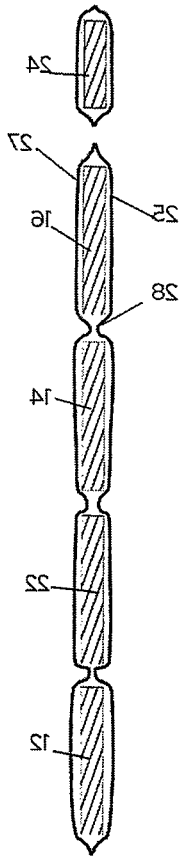
Figure 3.
Figure 4.
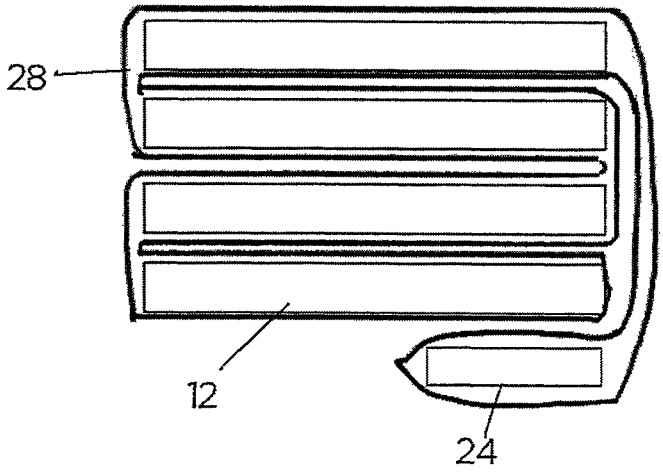

COLLAPSIBLE SPECTACLES CASE

CROSS-REFERENCE TO RELATED APPLICATION

This application claims priority from U.S. provisional application No. 61/634,979, filed Mar. 9, 2012.

TECHNICAL FIELD

This invention relates to protective cases, in particular to a collapsible holder for protecting articles contained therein while being used as a holder and the retention thereof when not being used as a holder.

DESCRIPTION OF THE PRIOR ART

There are many instances where a holder is made available for use in protecting an article of articles contained therein but raises a question as to its retention when the article or articles are removed therefrom. Eyeglasses are worn constantly on the face, yet sunglasses—because they are in constant transition and are more transitory in use, pose a greater risk for breakage during transport, and thus, present a bulky storage problem when the sunglasses are in use. U.S. Pat. No. 5,673,788 presents a partial solution with a collapsible case, yet its design does not efficiently address common sunglasses shapes that are more curved in nature. Its triangular and rectangular shape thus poses a space problem for more curvy and larger sunglasses.

SUMMARY OF THE INVENTION

This invention provides a collapsible holder for a breakable device, such as eyeglasses and more particularly sunglasses that provides a rigid protective holder for the breakable device when the device is not in use and a compact readily storable product when the breakable device is in use. While the collapsible holder is described herein as providing protection for sunglasses, it is understood that the collapsible holder can be used for holding other breakable articles or any article that must be protected while not in use or being transported from one location to another location and which holder can then be folded into a compact readily storable product.

In one embodiment of the invention, the collapsible holder for a breakable device, which for convenience sake will hereafter be referred to as sunglasses, comprises at least four relatively rigid members where two have a generally rectangular shape and the others a more half circle shape. Separable holding means are provided for holding the four main relatively rigid members in a spaced apart relationship when the four members have been pivoted to form an open ended rectangular shape in transverse cross section with the inner generally planar surfaces thereof in a facing relationship to form a cavity for containing the sunglasses when not in use. The end piece is longer than the rest and on its sides not joined to the other rigid members, are protruding tabs that fit into locating notches in the pivoting material hinges. This results in this relatively rigid member having a curved arc structure in the assembled case phase. Two side flaps connected to the second of the rectangular pieces pivot on similar hinges and fold over to overlap the longer arc piece.

In one embodiment of the inventions the four relatively rigid members, plus the two side rigid side tabs, are encased in two protective and continuous sheets where the members are adhered in between. Where there is space between the rigid members forms hinges that are of the two inner and outer sheets.

BRIEF DESCRIPTION OF THE DRAWINGS

FIG. 3 is a view in cross section of a collapsible holder.

FIG. 4 is a view in cross section of an embodiment of a collapsible holder in compact mode.

DETAILED DESCRIPTION

Figure 5:
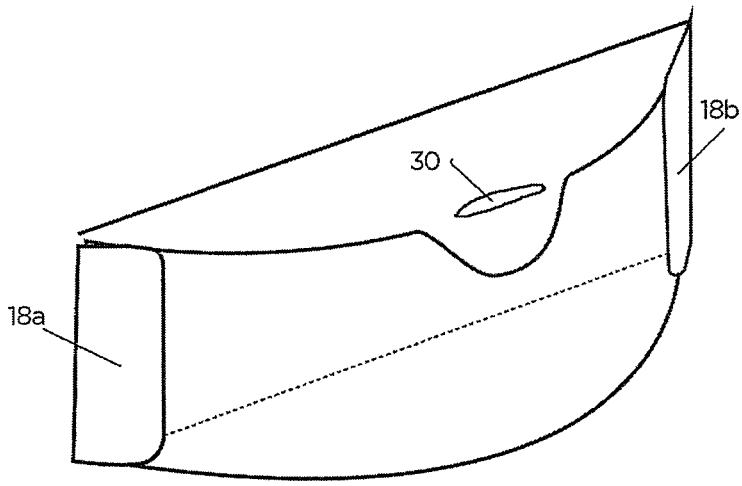
FIG. 5 is a view in isometric perspective of an embodiment of a collapsible holder in assembled mode.

The present invention is a glasses case 10 used to hold and protect a pair of glasses of all types. One feature of the present case 10 is that it is selectively collapsible between a fully functional arrangement, as shown in FIG. 5 wherein it can hold and protect a pair of glasses, and a collapsible arrangement, as shown in FIG. 1, wherein itself can be folded flat for easy storage.

Figure 1:
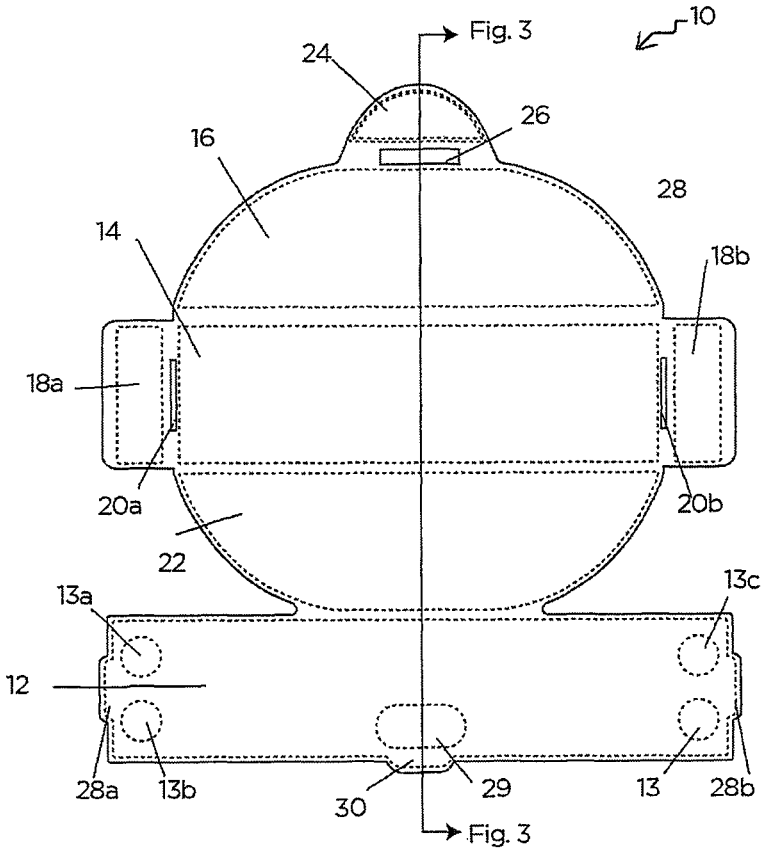
FIG. 1 is a top plan cross sectional view of an embodiment of a collapsible holder of the invention.
Figure 2:
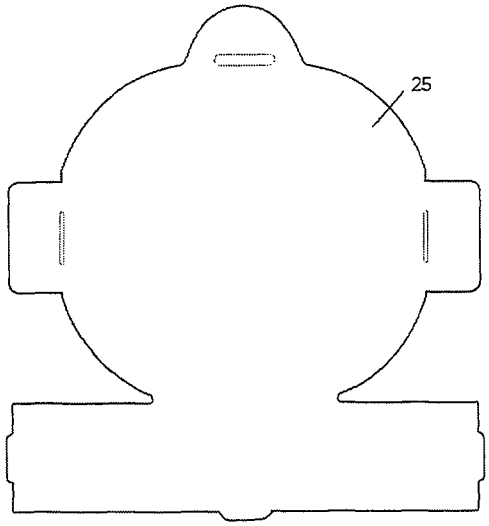
FIG. 2 is a top plan view of the assembly of an embodiment of a collapsible holder of the invention

Referring now to FIG. 1, glasses case 10, according to an embodiment of the invention includes a front panel 12, a rear panel 14, a top panel 16, two side locking tabs 18*a*, 18*b*, and two side locking slots 20*a*, 20*b* and a bottom panel 22. Top panel 16 further includes a tab 24 and a slot 26, while front panel 12 includes two side tabs 28*a*, and 28*b*, and a center tab 30. Embedded or attached on the surface of front panel 12 are attaching mechanisms 13*a*, 13*b*, 13*c* and 13*d*. Applicant contemplates these mechanisms to be magnets, hook and loop fasteners, or mechanical snaps. They will attach to corresponding pieces on side tabs 18*a* and 18*b*.

Each of the above-described panels, as described in greater detail below, is preferably made using a rigid or semi-rigid sheet material, such as ABS or polypropylene, cardboard, or even some sheet metals. According to this embodiment, the panels are cut to a predetermined shape and bonded between two opposing layers (a front layer 25, and a rear layer 27) of an appropriate flexible and durable laminate material, such as vinyl plastic, polyurethane, leather, or microfiber. Since one layer is deemed the interior layer, contacting the glasses in assembled mode, this layer will be of a material that protects and does not scratch lenses. An exemplary panel arrangement is shown in FIG. 1 (as dashed lines since they are located within front layer 25 and rear layer 27). The panels are spaced a consistent and predetermined distance from each other, thereby defining a hinge gap 28. Hinge gap 28 allows front layer 25 and rear layer 27 to contact each other during the laminating process so that a flexible bond is created. As is well known in this art, this flexible characteristic can be used to create a "living" hinge so that two adjacent panels can easily flex about the adjoining hinge gap 28 located between them. Note that hinge gaps 28 are located throughout the arrangement between any two adjacent panels. Depending on the thickness of the semi-rigid material, the hinge gap will accommodate so that there is easy movement of the panels. Alternatively, the device may be made of a rigid plastic with "living hinges" of thinner material, allowing the device to be manufactured as a single extruded piece.

Figure 6:
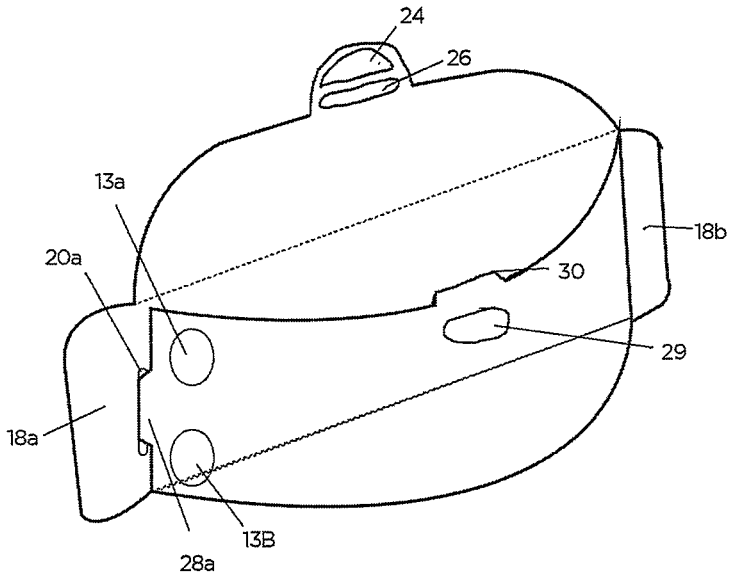
FIG. 6 is a close up view of one embodiment of how one rigid member locks into place.
Figure 7:
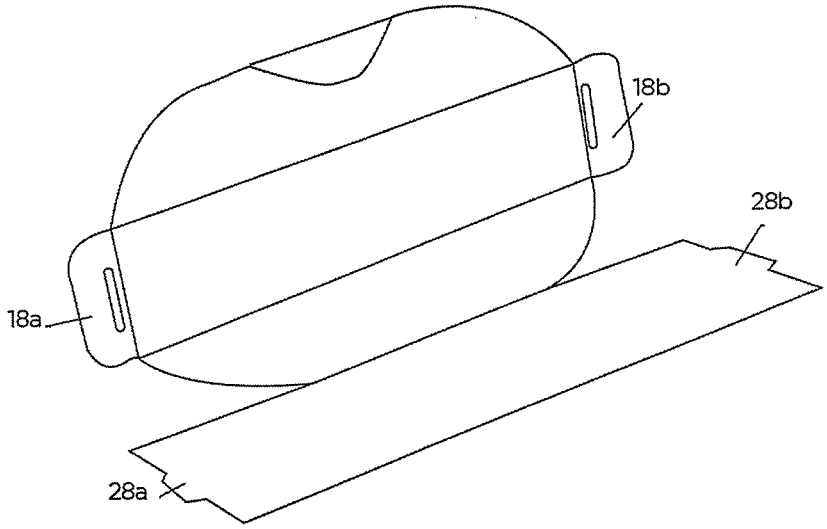
FIG. 7 is a isometric view of an embodiment of a collapsible holder of the invention prior to final assembly.

Referring now to FIGS. 1 and 6, to convert the glasses case 10 from the flat orientation and the assembled orientation, front panel 12 and rear panel 14 are pivoted so that they reside parallel to each other. The left side of front panel 12 is then curved rearwardly towards rear panel 14 so that side tab 28*a* can be inserted into side locking slot 20*a*, as illustrated in FIG. 6. Side locking tab 18*a* is then pivoted forward. The interior rigid structure inside tab 18*a* could be metal, or a fastener attached or formed on the surface. If tab 18*a* is metal, and 13*a* and 13*b* are both magnets, then tab 18*a* easily adheres onto the magnets, keeping the tab pivoted inward and secure. If there are hook fasteners present on tab 18, 13*a* and 13*b* are the corresponding loop fasteners, thus also keeping the tabs secure onto front panel 12. This step is repeated with the right side of front panel 12, side tab 28*b*, side locking slot 20*b*, and side locking tab 18*b*. Thus side tabs 18*a* and 18*b* can thus overlap front panel 12 and stay securely fastened. The front panel 12 is now forced to take on a curved shape. The resilient nature inherent in the front panel 12 (it wants to be straight and flat) helps hold the desired assembled structure, as shown in FIG. 7 and defines a cavity located between the front and rear panels into which glasses may be inserted, held and protected. Top panel 16 is pivotally attached to rear panel 14 between an open and closed position. The open position exposes the cavity. The closed position covers the cavity. In closed position, top tab 24 overlaps hook/loop or magnet attachment 29 so that the top panel 16 stays closed. During closure tab 30 fits into notch 26 so that the top panel 16 does not collapse inward into the cavity.

FIG. 5 shows the fully assembled embodiment where the side flaps 18*a* and 18*b* are pivoted inward and overlapping front panel 12. Top panel 16 overlaps the edges of front panel 12 and tab 30 protrudes through notch 26 to prevent movement.

During disassembly, pivoting side tabs 18*a* and 18*b* outwards releases tabs 28*a* and 28*b* shown in FIG. 7. Front panel 12 then resorts back to its original flat shape because of the semi rigid panel inside that basically acts as a spring.

Referring now to FIGS. 3 and 4 which are sectional views of the collapsible holder in unassembled phases, in FIG. 3, the front layer 25 and the rear layer 27 are seen to laminate and encase the semi rigid panels 24, 16, 14, 22, and 12.

In FIG. 4, all panels lie parallel to each other in a collapsed state. Hinge gap 28 must allow for neighboring panels to bend 180 degrees relative to each other. Top 24 adheres onto front panel 12 to keep case secure.

Figure 8:
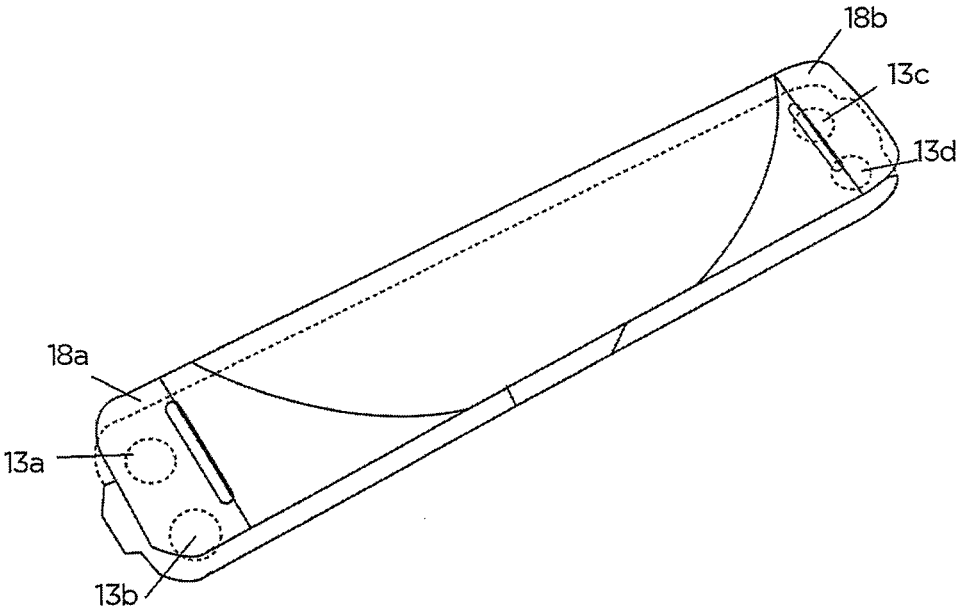
FIG. 8 is an isometric view of an embodiment of a collapsible holder in compact mode.

In FIG. 8, an isometric view of the collapsed state of FIG. 4, side tabs 18*a* and 18*b* adhere to Front panel 12 because of the fasteners existing to keep side tabs 18*a* and 18*b* attached to front panel 12 in assembled state. Since in one preferred embodiment, side panel 18*a* and 18*b* are made of a sheet metal material, they would attach securely to Front panel 12 in the case that 13*a-d* are magnets, to keep the case more strongly adhered in the compact state. Applicant contemplates using other fasteners in place of magnets, such as hook and loop fasteners or snaps.

What we claim is:

1. A foldable case for spectacles having a specified height comprising:

a sheet of foldable material divided into four panels, each panel separated by a pivoting hinge, said panels including;

two substantially rectangular panels;

two substantially half circle panels;

wherein said half circle panels are separated by a first said rectangular panel and may be folded along said pivoting hinges into a spaced apart, substantially parallel position separated by a width of said first rectangular panel to form a top and bottom of a case with said first rectangular panel forming a rear wall of said case;

wherein one of said half circle panels is joined to a said second rectangular panel centered in a middle third of a length of said second rectangular panel, such that when said two substantially half circle panels are substantially parallel, the second rectangular panel may be bent to form a curving front face of said case;

said second rectangular panel having end tabs centered on the width of said second rectangular panel that fit into receiving slots on opposing ends of said first rectangular panel, allowing a bent form to be retained;

said second rectangular panel having a centered closing tab that fits into a receiving slot on another of said half circle panels that abuts said second rectangular panel in a folded configuration, allowing said case to be held closed; and a pair of foldable end tabs on said first rectangular panel, said end tabs having fasteners that in a folded configuration fasten onto complementary fasteners on said second rectangular panel.

2. The case of claim 1, wherein said fasteners include magnets.

3. The case of claim 1, wherein said fasteners include snaps.

4. The case of claim 1, wherein said fasteners include hook and loop fasteners.

5. The case of claim 1, wherein said four panels may be folded into a superposed, parallel relationship with planar surfaces of each panel substantially perpendicular, forming a stack of folded panels.

6. A foldable case for spectacles having a specified height comprising:

a sheet of foldable material divided into four panels, each panel separated by a pivoting hinge, said panels including;

two substantially rectangular panels;

two substantially half circle panels;

wherein said half circle panels are separated by a said first rectangular panel and may be folded along said pivoting hinges into a spaced apart, substantially parallel position separated by a width of said first rectangular panel to form a top and bottom of a case with said first rectangular panel forming a rear wall of said case;

wherein one of said half circle panels is joined to a said second rectangular panel centered in a middle third of a length of said second rectangular panel, such that when said two substantially half circle panels are substantially parallel, the second rectangular panel may be bent to form a curving front face of said case;

said second rectangular panel having end tabs centered on the width of said second rectangular panel that fit into receiving slots on opposing ends of said first rectangular panel, allowing a bent form to be retained;

said second rectangular panel having a centered closing tab that fits into a receiving slot on another of said half circle panels that abuts said second rectangular panel in a folded configuration, allowing said case to be held closed; and a folding closing flap on said another of said half circle panels that abuts the second rectangular panel in the folded configuration, said closing flap having a fastener that secures to an outside face of said case on said second rectangular panel when said case is in the folded configuration.

7. The case of claim 6, wherein said fastener includes a fastener selected from the group consisting of a magnet, a hook and loop fastener, and a snap fastener.

* * * * *